United States Patent [19]

McCaffrey

[11] Patent Number: 4,716,342

[45] Date of Patent: Dec. 29, 1987

[54] POWER CIRCUIT FOR SPECTRAL ANALYSIS GASEOUS DISCHARGE LAMPS

[75] Inventor: John T. McCaffrey, Hamden, Conn.

[73] Assignee: The Perkin-Elmer Corporation, Norwalk, Conn.

[21] Appl. No.: 804,948

[22] Filed: Dec. 5, 1985

[51] Int. Cl.[4] ..... H05B 37/02; H05B 39/04; H05B 41/36; 363 23–26; 363 133; 363 134; 356 313; 315 DIG. 5; 315 DIG. 7; 315 306; 315 307; 315 219

[52] U.S. Cl. ..... 315/219; 315/DIG. 5; H05B 41/36

[58] Field of Search ..... 363/23-26, 133, 134; 356/313; 315/D., 5, Dig. 7, 306, 307, 219

[56] References Cited

U.S. PATENT DOCUMENTS

| | | | |
|---|---|---|---|
| 3,653,766 | 4/1972 | Walters et al. | 356/313 |
| 4,004,187 | 1/1977 | Walker | 363/23 |
| 4,277,726 | 7/1981 | Burke | 315/DIG. 7 |
| 4,356,416 | 10/1982 | Weischedel | 363/134 |
| 4,463,286 | 7/1984 | Justice | 315/DIG. 7 |
| 4,498,031 | 2/1985 | Stupp et al. | 315/307 |
| 4,535,458 | 8/1985 | Inoue et al. | 315/DIG. 7 |
| 4,553,039 | 11/1985 | Stifter | 363/134 |
| 4,553,199 | 11/1985 | Harada et al. | 363/24 |

*Primary Examiner*—Saxfield Chatmon
*Attorney, Agent, or Firm*—Ronald G. Cummings; Francis L. Masselle; Edwin T. Grimes

[57] ABSTRACT

The circuit includes an inverter to be connected to a source of d.c. power. The inverter has a transformer with a center-tapped primary winding. Separate controllable switching devices are connected to the respective ends of the primary winding. Both switching devices are arranged to be connected in common to one output terminal of the d.c. power source. The center tap of the transformer primary winding is arranged for connection to the other output terminal of the d.c. power source. The transformer has a laminated silicon steel core, and includes a secondary winding arranged for connection across the input terminals of a gaseous discharge lamp. A control circuit is connected to control conduction by the separate controllable switching devices in alternating sequence at a desired frequency of operation.

17 Claims, 1 Drawing Figure

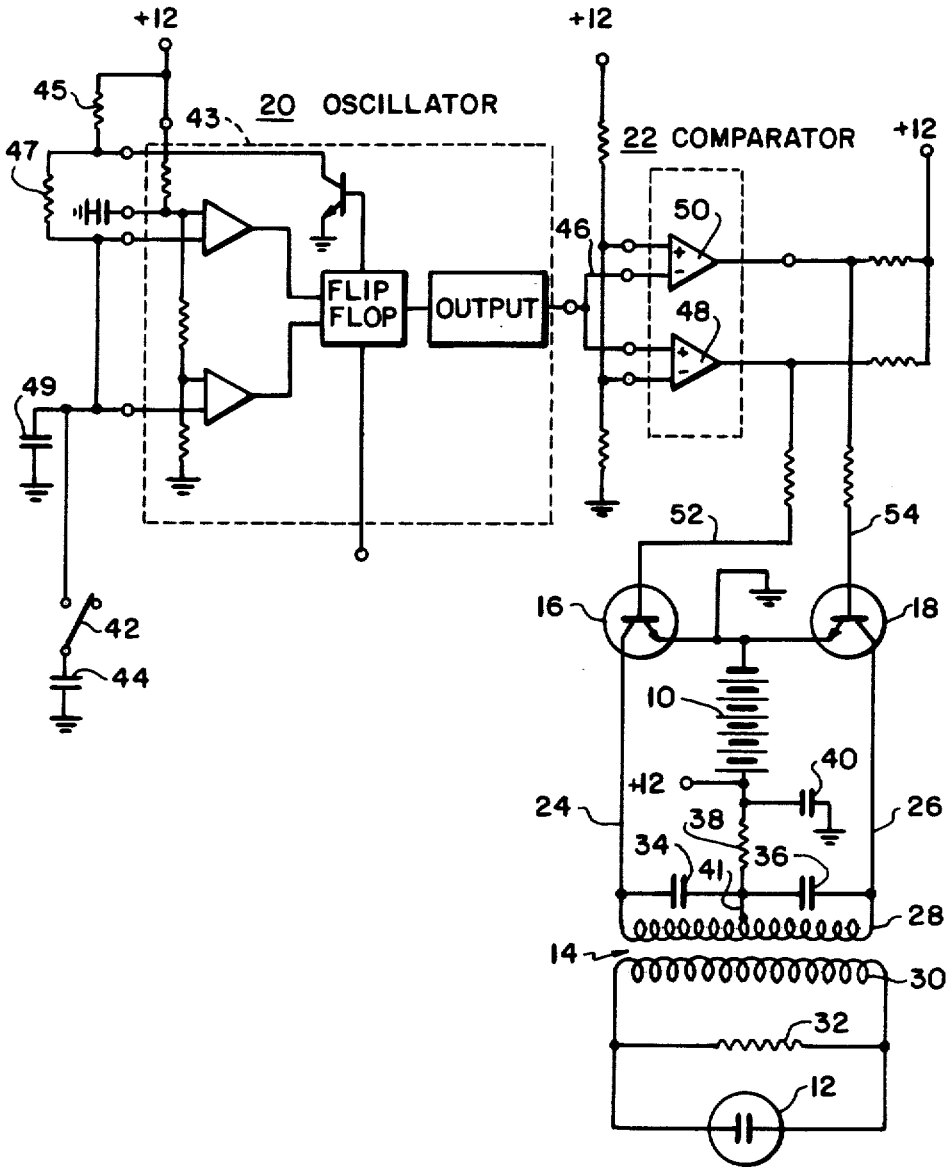
+12
45
43
20 OSCILLATOR
47
FLIP FLOP
OUTPUT
49
42
44
+12
22 COMPARATOR
+12
50
46
48
52
54
16
18
10
+12
40
24
26
38
34
41
36
28
14
30
32
12

POWER CIRCUIT FOR SPECTRAL ANALYSIS GASEOUS DISCHARGE LAMPS

BACKGROUND OF THE INVENTION

The present invention relates to power circuits which are especially useful for gaseous discharge lamps which are to be used in analytical apparatus such as liquid chromatographs.

In liquid chromatography, as well as in other optical analytical instruments, it is extremely important that the sources of light employed for the spectral analysis must be consistent and uniform in light output. This is especially important in liquid chromatography where particular spectral lines are detected and recorded at particular time intervals. If the source of illumination is interrupted, or is decreased or increased during the critical brief interval when a spectral line is being recorded, the result is a gross inaccuracy.

Accordingly, it has been common practice in the past to employ a carefully voltage regulated direct current power circuit for optical analytical instruments of the above nature. This avoids the possible problem that inherent fluctuations in the light output associated with of alternating current will interfere with the measurements by the analytical instruments.

However, it has been discovered that direct current power supply circuits for gaseous discharge lamps used in analytical instruments have a number of disadvantages, including high cost, high energy consumption, and limited lamp life.

Accordingly, it is one object of the present invention to provide an improved power circuit for spectral analysis gaseous discharge lamps which provides for reduced energy consumption.

It is another object of the present invention to provide an improved power circuit for spectral analysis gaseous discharge lamps which provides for greater reliability in starting conduction and illumination of the lamp.

It is still another object of the present invention to provide an improved power circuit for spectral analysis gaseous discharge lamps which provides for improved lamp life.

Accordingly, it is one object of the present invention to provide an improved power circuit for spectral analysis gaseous discharge lamps which provides the other advantages enumerated above at a reduced cost.

In spectral analysis apparatus, it is often desired to employ gaseous discharge lamps having different gases in order to obtain different radiation spectra for specialized spectral measurements. Changing such lamps can involve serious problems in that different lamps require different operating voltages and different operating. currents. Normally, making the necessary changes in the power supply for the lamps in order to change from one gas filled lamp to a gas filled lamp filled with a different gas would involve makiing substantial changes in the high voltage output side of the lamp power supply circuit, such as changing transformer taps or inserting series resistances.

Accordingly, it is another important object of the present invention to provide an improved power circuit for spectral analysis gaseous discharge lamps which is very easily changed to accommodate for lamps having different current and voltage requirements by means of a simple change in the low voltage control circuitry of the power circuit.

The above objects are carried out by providing an improved power circuit for spectral analysis gaseous discharge lamps which employs a high frequency output to the lamp. In prior power circuits for high frequencies, it has generally been thought to be a requirement that ferrite cores be employed in any transformers which are to be operated at the high frequency. Such ferrite cores provide good voltage regulation and predictable ratios between input and output voltages. They also limit eddy current losses and the associated generation of heat. However, ferrite cores are expensive. Furthermore, the fixed ratio of input voltage to output voltage provided with a ferrite core means that a very high output voltage must be provided to fire the gaseous discharge lamp, and then some exterior means must be provided to limit the current through the lamp, sometimes referred to as a "ballast", because of the negative resistance characteristic of a gaseous discharge lamp.

Accordingly, it is another object of the invention to provide an improved power circuit for a spectral analysis gaseous discharge lamp which avoids the cost of ferrite cores and avoids the cost and requirement for a separate ballast by providing a transformer structure which is capable of serving inherently as a ballast.

Further objects and advantages of the invention will be apparent from the following description and the accompanying drawings.

SUMMARY OF THE INVENTION

In carrying out the invention there is provided a high frequency power circuit for a spectral analysis instrument gaseous discharge lamp comprising an inverter arranged for connection to a source of d.c. power to be inverted, said inverter including a transformer having a center-tapped primary winding, separate controllable switching devices connected to the respective ends of said primary winding of said transformer and both being arranged to be connected in common to one output terminal of the d.c. power source, the center tap of said transformer primary winding being arranged for connection to the other output terminal of the d.c. power source, said transformer having a laminated silicon steel core, said transformer including a secondary winding arranged for connection across the input terminals of a gaseous discharge lamp, a control circuit including an oscillator connected to control conduction by said separate controllable switching devices in alternating sequence at a desired frequency of operation.

BRIEF DESCRIPTION OF THE DRAWING

The drawing is a schematic circut diagram illustrating a preferred embodiment of the invention.

DESCRIPTION OF PREFERRED EMBODIMENTS

Referring more particularly to the drawing, power from a dc source schematically shown as the battery 10 is delivered to the gaseous discharge lamp 12 through a transformer 14 and through controllable switching devices 16 and 18. The switching devices 16 and 18 are controllable by means of a control circuit including an oscillator circuit 20 and a comparator circuit 22. This power cuit is an inverter, which inverts the dc power from source 10 to ac power at lamp 12.

The power source 10 is schematically illustrated as a six cell battery which delivers 12 volts dc. However, it iwll be understood that the dc power source need not necessarily include a battery. As illustrated, the negative terminal of the battery is grounded and the positive terminal is labelled +12. For simplicity, ground connections and +12 volt connections in other parts of the circuit are simply indicated by the ground symbol and the designation "+12" respectively. The switching devices 16 and 18 are connected, as shown at 24 and 26, to the opposite ends of the center tapped primary winding 28 of the transformer 14. Also, both switching devices are connected in common to the ground (negative) terminal of the dc power source. The transformer 14 is preferably a laminated silicon steel core transformer which may be similar to those designed for operation at 60 hertz.

As a safety feature to avoid an excessive voltage on the secondary winding 30 of the transformer 14, a resistor 32 is provided. Resistor 32 is a low power dissipation resistor which has a high resistance such as one megohm. It is provided for limiting the voltage across the secondary winding 30 in case the lamp 12 has not been plugged in, or fails to "fire". This reduces the insulation requirements of the transformer.

Other precautions are preferably taken to avoid transient voltage spikes. For instance, capacitors 34 and 36 are provided for this. This purpose is also served by the filter including the combination of resistor 38 and capacitor 40, through which the center top 41 of primary winding 25 is connected to the positive terminal of power supply 10.

The controllable switching devices 16 and 18 are illustrated, for simplicity, as single bipolar transistors. However, these devices are preferably "Darlington" transistors which consist of a combination of transistors which provides a very high gain. In one preferred embodiment, a General Electric NPN Darlington power transistor model D44d5 was used for each switching device. Alternatively, field effect transistors may be employed for the controllable switching devices 16 and 18. In one alternative preferred embodiment, a Siliconix power MOSFET model VN 1206D field effect transistor was used for each switching device.

As previously mentioned, the control circuit for the controllable switching devices 16 and 18 includes an oscillator 20 and a comparator 22. The oscillator is preferably a precision device which provides a substantially unvarying output at a selected frequency. The oscillator preferably includes a monolithic timing circuit 34 which may be a standard monolithic timing circuit model 555. The portion of the circuit within the dotted box 43 is a schematic functional representation of the 555 monolithic timing circuit. Such a circuit is available from various suppliers, including Signetics.

Exterior to the dotted box 43, there are shown components and connections for operation of the monolithic circuit as an oscillator. The circuit constants of those external components determine the frequency at which the oscillator operates. For instance with external resistor 45 at 1,000 ohms, with external resistor 47 at 57.6 kilohms, and with capacitor 49 at 500 picofarads, the oscillation frequency is 28 kilohertz. This is the operating frequency of one preferred embodiment of the circuit when the gaseous discharge lamp 12 is a mercury lamp.

If the circuit is to be operated to supply a zinc lamp, instead of a mercury lamp, the frequency is preferably changed from 28 kilohertz to 700 hertz. This is simply accomplished by means of a switch 42 which connects an additional capacitor 44 in parallel with capacitor 40 to increase the capacity of the combination. The capacitor 44 may have a value of 0.02 microfarads.

The basic purpose in changing the frequency is to change the output voltage, current, and power coupling to the lamp 12.

It will be apparent that this same procedure may be used to change the oscillator frequency to other desired values, by inserting other capacitors in parallel with capacitor 49 by means of other switches (not shown). Also, if desired, the frequency of the oscillator can be changed by changing the value of the resistance 47, or the resistance 45. Furthermore, control device may be provided for a continuous change in resistance or capacitance to provide for a continuous change in frequency, rather than a stepwise change.

The output of the oscillator is supplied, as indicated at 46, to opposite inputs of two comparator amplifiers 48 and 50 which comprise parts of the comparator 22, and which are operable to be switched by the oscillator pulses to provide timed alternate oppositely polled control pulses to the control inputs 52 and 54 of the controllable switching devices 16 and 18. The comparators 48 and 50 are preferably high precision comparators, and both comparators may be included in a monolithic comparator circuit available from National Semiconductor under the model number LM339.

The reason for changing the frequency of the oscillator 20 is basically to adjust the current and voltage supplied to the gaseous discharge lamp 12. As the frequency is reduced, the current supplied to the gaseous discharge lamp load is increased. Since the zinc vapor lamp requires substantially more current than the mercury vapor lamp, this is the desired result.

The particular selection of frequencies is not critical. However, with a particular embodiment, as implemented, the frequencies mentioned above were found to achieve the desired results.

In a preferred embodiment of the invention, when the oscillator is operated at 28 kilohertz for energizing a mercury gaseous discharge lamp 12, the supply current at the dc supply source at 12 volts is 300 milliamperes. However, the lamp current at the lamp 12 is only 4 milliamperes at 340 volts ac. Furthermore, the voltage wave is substantially a sine wave.

By simply shifting the switch 42 to add capacitor 44 to capacitor 40, the frequency of the oscillator is shifted to about 700 hertz, rsulting in an increase in the current from dc source 10 to 750 milliamperes, with almost a sixfold increase in current supplied to the zinc vapor lamp 12 to 23 milliamperes, but at a somewhat reduced steady-state voltage of 200 volts. At this reduced frequency, the output voltage to the lamp 12 is substantially a square wave. Thus, a drastic change in the power delivery of the system is accomplished with a relatively minor change in the low voltage control circuit.

The transformer 14 is preferably a silicon steel core transformer of the type which is often used for operation at 60 hertz. In one preferred embodiment, a small transformer was employed having a turns ratio of about 23 turns in the secondary winding 30 for every one turn in the primary winding 28. The transformer was very similar to a transformer model DST 4-10, offered as a PC board transformer by Signal Transformer of 500 Bayview Ave., Inwood, NY 11696. However, the windings designated as secondaries were used as primaries, and the winding designated as the primary was used as the secondary. The nominal volt-ampere rating at 60 hertz is 6. At the high frequencies employed, it was found that the open circuit voltage across the secondary winding 30 was much higher than would be predicted from the turns ratio. Thus, while gaseous discharge lamps for analytical applications require very high initial firing voltages, there was no serious difficulty in obtaining starting voltages as high as 2,000 volts or more in order to initiate conduction. Because of the negative impedence characteristic of the gaseous tube 12, as soon as the gaseous discharge begins, the voltage drops drastically and the current increases appreciably. Fortunately, the silicon steel lamination core transformer 14 provides the necessary impedence to prevent the current from becoming excessive, thus permitting efficient operation without the need for a separate series ballast impedence in the lamp circuit.

The voltage limiting effect of the silicon steel core transformer 14 also has the desirable result of assisting in the filtering of high harmonic frequencies which reduces the radio frequency interference emissions from the apparatus, a desirable result.

With a circuit with good voltage regulation, such as with a transformer having a ferrite core, it is necessary to design the transformer to provide a substantially high voltage in order to reliably start the gaseous discharge, but to then include a series resistor, or other impedence, to limit the voltage and current after the gaseous discharge is started.

The same problem exists with a direct current power circuit for energization of the gaseous discharge tubes. Furthermore, with a direct current power circuit, the series impedence must be a resistance, which results in a substantial energy loss. It has been found to be one of the most important advantages of the present invention that a substantial saving in energy is achieved as compared to a direct current power circuit, and the power consumption rating of the power circuit may be substantially reduced.

While the analytical instrumentation lamps to be energized by the present circuit are intended to be employed for measurements involving rapidly changing transient optical conditions, it has been found that direct current energization of the lamp is not essential as long as the frequency of operation of the lamp is substantially higher than that corresponding to the rise and fall of transient optical signals to be detected. Thus, 700 hertz and higher has been found to be more than satisfactory. Furthermore, higher frequency energization of the gaseous discharge lamps has been found to be generally more efficient than lower frequency energization.

Also, it is recognized that alternating current energization of the gaseous discharge lamps results in longer lamp life than does direct current energization.

While the feature involving the frequency changing switch 42 is exceedingly valuable, it is obvious that the invention is worthwhile for producing single operating frequencies, omitting the switch 42 and capacitor 44.

The capacitor 44 is preferably a polystyrene capacitor which is highly resistant to changes in capacity with changes in temperature. Any such change in capacity would cause an undesired frequency shift in the operation of the oscillator.

The capacitor 40 is preferably a mica capacitor which is also highly resistant to changes in capacity in response to temperature changes.

The present invention may be employed for powering many different types of gaseous discharge optical instrument lamps. Such lamps are available for instance from Hamamatsu Corporation, 420 South Avenue, Middlesex, NJ 08846, and may include, for instance, a mercury filled capillary lamp model L1212, zinc lamps, cadmium lamps, low pressure mercury lamps, phosphor coated mercury lamps, and the low pressure mercury lamps. Such optical instrument lamps are also available from Spectronics Corporation, 956 Brush Hollow Road, Westbury, NY 11590. A zinc lamp model Z800, and a cadmium lamp model CD480 are also available from UVP Inc., 5100 Walnut Grove Avenue, San Gabriel, CA 91788.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

What is claimed is:

1. A high frequency power circuit for a spectral analysis instrument gaseous discharge lamp comprising an inverter arranged for connection to a source of d.c. power to be inverted, said inverter including a transformer having a center-tapped primary winding, separate controllable switching devices connected to the respective ends of said primary winding of said transformer and both being arranged to be connected in common to one output terminal of the d.c. power source, the center tap of said transformer primary winding being arranged for connection to the other output terminal of the d.c. power source, said transformer having a laminated silicon steel core, said transformer including a secondary winding arranged for connection across the input terminals of a gaseous discharge lamp, a control circuit including an oscillator connected to control conduction by said separate controllable switching devices in alternating sequence at a desired frequency of operation.

2. A circuit as claimed in claim 1 wherein said control circuit to control conduction by said controllable switching devices comprises a discrete oscillator circuit.

3. A circuit as claimed in claim 2 wherein said control circuit to control conduction by said controllable switching devices includes a comparator circuit connected to receive signals from said discrete oscillator circuit and operable to generate timed alternate control pulses to said respective controllable switching devices.

4. A circuit as claimed in claim 2 wherein said oscillator is a precision oscillator which is operable to hold the frequency of oscillation within narrow limits to maintain a consistent delivery of energy to the gaseous discharge lamp so as to maintain a consistency of output illumination as required for an optical analytical instrument.

5. A high frequency power circuit for a spectral analysis instrument gaseous discharge lamp comprising an inverter arranged for connection to a source of d.c. power to be inverted, said inverter including a transformer having a center-tapped primary winding, separate controllable switching devices connected to the respective ends of said primary winding of said transformer and both being arranged to be connected in common to one output terminal of the d.c. power source, the center tap of said transformer primary winding being arranged for connection to the other output terminal of the d.c. power source, said transformer having a laminated silicon steel core, said transformer including a secondary winding arranged for connection across the input terminals of a gaseous discharge lamp, said transformer being a voltage step-up transformer which is operable to provide a substantially high open circuit secondary voltage to commence the gaseous arc discharge within the lamp, a control circuit including an oscillator connected to control conduction by said separate controllable switching devices in alternating sequence at a desired frequency of operation.

6. A circuit as claimed in claim 5 wherein a resistance is connected across the secondary winding of said transformer to limit the open circuit voltage and to thereby limit the insulation requirements of said transformer.

7. A circuit as claimed in claim 5 wherein the impedence of said transformer serves to limit the current of the gaseous discharge lamp so as to avoid the need for a separate current limiting ballast device.

8. A high frequency power circuit for a psectral analysis instrument gaseous discharge lamp comprising an inverter arranged for connection to a source of d.c. power to be inverted, said inverter including a transformer having a center-tapped primary winding, separate controllable switching devices connected to the respective ends of said primary winding of said transformer and both being arranged to be connected in common to one output terminal of the d.c. power source, the center tap of said transformer primary winding being arranged for connection to the other output terminal of the d.c. power source, said transformer having a laminated silicon steel core, said transformer including a secondary winding arranged for connection across the input terminals of a gaseous discharge lamp, a control circuit including an oscillator connected to control conduction by said separate controllable switching devices in alternating sequence at a desired frequency of operation, and means for changing the frequency of said oscillator to thereby change the output current of said circuit.

9. A circuit as claimed in claim 8 wherein the frequency of said oscillator is controlled by the combination of a resistor component and a capacitor component, and wherein said means for changing the frequency of said oscillator comprises a means for changing at least one of said resistor and said capacitor components.

10. A circuit as claimed in claim 9 wherein said capacitor component is changed to accomplish a frequency change by selectively switching a separate capacitor device in or out of the circuit to increase or decrease the capacitance of said capacitor component.

11. A circuit as claimed in claim 10 wherein said oscillator is operable at a first frequency of 28 kilohertz when said circuit is operable to supply current to a mercury discharge lamp and wherein the frequency of said oscillator is changeable to 700 hertz by adding an additional capacitance to said oscillator when said circuit is operable to supply current to a zine gaseous discharge lamp.

12. A circuit as claimed in claim 1 wherein said oscillator is operable at 28 kilohertz and said circuit is operable to provide current appropriate for a mercury gas discharge lamp.

13. A circuit as claimed in claim 1 wherein said oscillator is operable at 700 hertz and said circuit is operable to provide current appropriate for a zinc gas discharge lamp.

14. A circuit as claimed in claim 1 wherein said controllable switching devices are solid state switching devices.

15. A circuit as claimed in claim 14 wherein said solid state switching devices are transistor devices.

16. A circuit as claimed in claim 15 wherein each of said solid state switching devices comprises a Darlington circuit combination of transistors.

17. A circuit as claimed in claim 15 wherein each of said transistors comprises a field effect transistor.

* * * * *

UNITED STATES PATENT AND TRADEMARK OFFICE

CERTIFICATE OF CORRECTION

PATENT NO. : 4,716,342

DATED : December 29, 1987

INVENTOR(S) : John T. McCaffrey

It is certified that error appears in the above-identified patent and that said Letters Patent is hereby corrected as shown below:

Column 8, line 21, change "zine" to --zinc--.

Signed and Sealed this

Sixth Day of June, 1989

*Attest:*

*Attesting Officer*

DONALD J. QUIGG

*Commissioner of Patents and Trademarks*